US011060533B2

(12) United States Patent
Costa et al.

(10) Patent No.: US 11,060,533 B2
(45) Date of Patent: Jul. 13, 2021

(54) LOGIC-CONTROLLED FLOW COMPENSATION CIRCUIT FOR OPERATING SINGLE-ROD HYDROSTATIC ACTUATORS

(71) Applicant: University of Manitoba, Winnipeg (CA)

(72) Inventors: Gustavo Koury Costa, Casa Amarela (BR); Nariman Sepehri, Winnipeg (CA)

(73) Assignee: University of Manitoba, Winnipeg (CA)

( * ) Notice: Subject to any disclaimer, the term of this patent is extended or adjusted under 35 U.S.C. 154(b) by 0 days.

(21) Appl. No.: 16/636,996

(22) PCT Filed: Aug. 22, 2018

(86) PCT No.: PCT/CA2018/051009

§ 371 (c)(1),
(2) Date: Feb. 6, 2020

(87) PCT Pub. No.: WO2019/051582

PCT Pub. Date: Mar. 21, 2019

(65) Prior Publication Data

US 2020/0256353 A1 Aug. 13, 2020

Related U.S. Application Data

(60) Provisional application No. 62/574,326, filed on Oct. 19, 2017, provisional application No. 62/557,389, filed on Sep. 12, 2017.

(51) Int. Cl.
*F15B 7/00* (2006.01)

(52) U.S. Cl.
CPC ..... *F15B 7/006* (2013.01); *F15B 2211/20561* (2013.01); *F15B 2211/27* (2013.01);
(Continued)

(58) Field of Classification Search
CPC ..... F15B 7/006; F15B 2211/20561; F15B 2211/27; F15B 2211/613; F15B 2211/7053; F15B 2211/785; F15B 2211/635
See application file for complete search history.

(56) References Cited

U.S. PATENT DOCUMENTS 7,234,298 B2 * 6/2007 Brinkman ..... E02F 9/2217 60/414
8,701,400 B2 4/2014 Kondo et al.
(Continued)

FOREIGN PATENT DOCUMENTS

EP 2728203 9/2013
WO 2013112109 8/2013
WO WO-2013112109 A1 * 8/2013 ..... F15B 7/006

*Primary Examiner* — Thomas E Lazo
(74) *Attorney, Agent, or Firm* — Kyle R. Satterthwaite; Michael R Williams; Ade & Company Inc.

(57) ABSTRACT

A single-rod hydrostatic actuator or pump-controlled actuator, comprises a hydrostatic pump connected in a closed circuit to a single-rod hydraulic cylinder where the cylinder velocity is directly controlled by the pump flow, without the need of intermediary valves. Due to the absence of throttling losses, the efficiency of hydrostatic actuators is considerably superior to the efficiency of conventional valve-controlled circuits. However, because of the differential areas at the cap and rod sides of the cylinder, the flows coming into and out of the cylinder do not match. Several attempts have been made to this date to produce a stable, robust and reliable circuit that can be used in everyday applications but no circuit has ever been conceived to reach the high standards of reliability and robustness required by industry. The current invention solves the problem of the differential flows with a design that is reliable, oscillation-free and robust. The present conception is based on the correction of a misstated theory concerning the modus operandi of hydrostatic actua-
(Continued)

tors. The resulting design can be translated into different embodiments using electronic or hydraulic technologies and uses only logical combinations of the pressure readings at the cap and rod-sides of the circuit.

22 Claims, 4 Drawing Sheets

(52) U.S. Cl.
CPC . *F15B 2211/613* (2013.01); *F15B 2211/7053* (2013.01); *F15B 2211/785* (2013.01)

(56) References Cited

U.S. PATENT DOCUMENTS

2016/0032945 A1* 2/2016 Oho ..... F15B 13/027 60/413
2016/0076558 A1 3/2016 Gomm et al.

* cited by examiner $$F_R = (\alpha p_p - p_a) A_a$$

LOGIC-CONTROLLED FLOW COMPENSATION CIRCUIT FOR OPERATING SINGLE-ROD HYDROSTATIC ACTUATORS

FIELD OF THE INVENTION

The present invention relates to a hydrostatic actuator comprising a hydrostatic pump, a hydraulic cylinder, a low-pressure fluid supply module or charge circuit for supplementing uneven fluid flows entering and exiting the cylinder due to differential areas across the piston thereof.

BACKGROUND

The purpose of the invention can be understood with the help of FIG. 1, which illustrates a hydrostatic actuator of the type briefly summarized above, where a reversible pump 5 driven by a prime mover 6 has a first port 1 directly connected to the cap side cylinder port 2 by a first main fluid line L1, and the rod side cylinder port 3 is directly connected to the pump's second port 4 through a second main fluid line L2, thereby forming a closed circuit. In the mode of operation shown in FIG. 1, with the pump 5 operating in a first direction pumping output fluid through the first port 1 and receiving return fluid through the second port 4 in order to extend the hydraulic cylinder, as the cylinder 7 extends at a speed v the differential piston and annulus areas $A_p$ and $A_a$ at opposite sides of the piston receive and deliver the volumetric flows $A_p v$ and $A_a v$, respectively. As a result, the flows into and out of the pump/motor 5 are different, which causes the circuit to malfunction.

In the first case shown in FIG. 1, the flow into the cylinder is higher than the flow out of the cylinder. As a result, there is not sufficient fluid to feed the pump at the input port. The pressure $p_a$ in this case, would soon become too low and the circuit would become inviable. If the pump displacement is reversed, in order to pump output fluid through the second pump port 4 and receive return fluid through the first pump port 1 in order to retract the hydraulic cylinder, as shown in FIG. 2, the opposite situation happens, as a higher flow is forced into the pump input, increasing the pressure $p_p$.

It is therefore necessary to provide a means of equalizing the flows coming into and out of the pump through ports 1 and 2 by redirecting fluid from a charging circuit into and out of main lines L1 and L2 as required to equalize the flows at ports 1 and 4 at the pump 5. That is, it is necessary to provide a charging circuit that complements the lacking flow into the cylinder rod-side when the pump operates in the manner shown in FIG. 1, and removes the extra flow fluid from the cylinder cap-side when the pump operates in the manner shown in FIG. 2.

Several designs aiming to fulfil these requirements have been proposed through the years. In a nutshell, the solutions can be divided into two categories, namely valve-compensated circuits and pump-compensated circuits. Valve-compensated circuits are those in which the circuit flows are matched by connecting the cylinder ports to a low-pressure reservoir or a charge circuit using hydraulic valves. Pump-compensated circuits, on the other hand, use hydraulic pumps to provide the matching flow in or out of the circuit, as needed.

However, there remains room for improvement, in response to which the present inventors have developed a unique and elegant solution to address the forgoing challenges in hydrostatic actuator control.

SUMMARY OF THE INVENTION

According to a first aspect of the invention, there is provided a hydrostatic actuator comprising:

a hydraulic cylinder;

a reversible hydraulic pump;

a first main fluid line connecting a first side of the reversible hydraulic pump to a cap side of the hydraulic cylinder;

a second main fluid line connecting a second side of the reversible hydraulic pump to a rod side of the hydraulic cylinder;

a hydraulic charging circuit for supplying/releasing charging fluid to and from the first and second main fluid lines to compensate for differential flow on opposing sides of the hydraulic cylinder;

a charge control system configured to (i) monitor a weighted pressure differential across a piston of the hydraulic cylinder, (ii) connect the hydraulic charging circuit to the rod side of the hydraulic cylinder when a weighted cap side pressure exceeds the rod side pressure, and (iii) connect the hydraulic charging circuit to the cap side of the hydraulic cylinder when the weighted cap side pressure is less than the rod side pressure.

Preferably the charge control system is further configured to connect the hydraulic charging circuit to the rod side or the cap side of the hydraulic cylinder only when a predetermined pressure threshold is exceeded at the cap side or rod side, respectively.

Preferably the charge control system comprises a signal processing module comparing the rod side and cap side pressures, and a compensation flow module controlling flow from the charge circuit to the rod side and cap side of the hydraulic cylinder according to pressure comparison results from the signal processing module.

The signal processing module may be a hydraulic module or an electronic module.

The electronic signal processing module preferably comprises transducers operable to measure pressures at the cap side and the rod side of the hydraulic cylinder.

In the instance of an electronic signal processing module, the compensation flow module preferably comprises an electronically controlled valve operated, at least in part, based on output signals from the electronic signal processing module.

In the instance of a hydraulic signal processing module, the charge control system preferably comprises a pressure amplifier fed by pressure of the cap side of the hydraulic cylinder, and configured with a pressure gain based on a ratio of a full piston area of the hydraulic cylinder on the cap side thereof to an annular piston area of the hydraulic cylinder on the rod side thereof.

In the instance of a hydraulic signal processing module, the charge control system preferably comprises a pressure-comparing directional valve fed by the charging circuit and hydraulically piloted in opposite directions from the cap side pressure and the rod side pressure.

In such instance, preferably the pressure-comparing directional valve comprises a charge port fed by the charging circuit, a dump port connected to a tank, and two connection ports for feeding two respective pilots of one or more compensation flow control valves that are operable to open and close connections of the charging circuit to the cap side and rod side of the hydraulic actuator, each connection port being communicated with either the charge port or the dump port depending on a current position of the pressure-comparing direction valve.

In the instance of a hydraulic signal processing module, the charge control system preferably comprises a pair of spring-biased valves having respective pilots pressured by the cap side and rod side of the hydraulic cylinder.

The pair of spring biased valves may comprise cracking valves normally biased into closed positions between the pressure-comparing directional valve and the pilots of the one or more compensation flow control valves.

Alternatively, the pair of spring biased valves may comprise a first counterbalance valve installed in the first main line and piloted by the rod side of the hydraulic cylinder, and a second counterbalance valve installed in the second main line and piloted by the cap side of the hydraulic cylinder, each counterbalance valve always allowing flow therethrough from the pump to the hydraulic cylinder, but only allowing flow in a reverse direction from the hydraulic cylinder to the pump when the respective side of the cylinder from which the counterbalance valve is piloted is at a pressure value exceeding a cracking pressure of said counterbalance valve.

In the instance of a hydraulic signal processing module, the charging circuit may comprise a pair of directional spring-biased compensation flow control valves each operable to open and close a path from a low pressure flow source of the charging circuit to a respective one of either the cap side or the rod side of the hydraulic actuator.

More specifically, the one or more compensation flow control valves may comprise first and second spring-biased directional control valves respectively comprising the first and second pilots, and each connected between a low pressure flow source of the hydraulic charging circuit and a respective one of either the cap side or the piston side of the hydraulic cylinder.

Alternatively, the charging circuit may comprise a singular three-position directional compensation flow control valve movable from a default closed position disconnecting a low pressure flow source of the charging circuit from both the cap side and the piston side of the hydraulic cylinder, into either of two open positions each connecting the low pressure flow source to a respective one of either the cap side or the piston side of the hydraulic cylinder.

More specifically, the one or more compensation flow control valves may be a singular three-position directional control valve having the first and second pilots defined at opposing ends thereof, said singular three-position directional control valve being movable from a default closed position disconnecting a low pressure flow source of the hydraulic charging circuit from both the cap side and the piston side of the hydraulic cylinder, into either one of two open positions that each connect the low pressure flow source to a respective one of either the cap side or the piston side of the hydraulic cylinder.

The low pressure flow source communicable with the hydraulic actuator via the one or more compensation flow control valves may also feed the charge port of the pressure-comparing directional valve.

According to a second aspect of the invention, there is provided a method of controlling fluid flow to and from a hydraulic charging circuit in a hydrostatic actuator through hydraulic valves, said method comprising monitoring a weighted pressure differential across a piston of a hydraulic cylinder, connecting the hydraulic charging circuit to a rod side of the hydraulic cylinder when a weighted cap side pressure exceeds the rod side pressure, and connecting the hydraulic charging circuit to the cap side of the hydraulic cylinder when the weighted cap side pressure is less than the rod side pressure.

The method may comprise monitoring the weighted pressure differential using a hydraulically operated signal processing module.

Alternatively, the method may comprise monitoring the weighted pressure differential using an electronically operated signal processing module.

BRIEF DESCRIPTION OF THE DRAWINGS

One embodiment of the invention will now be described in conjunction with the accompanying drawings in which:

FIG. 3(*b*) shows the flow pattern experienced in the hydrostatic actuator circuit in each of the four quadrants of the FIG. 3(*a*) diagram.

DETAILED DESCRIPTION

Figure 3:
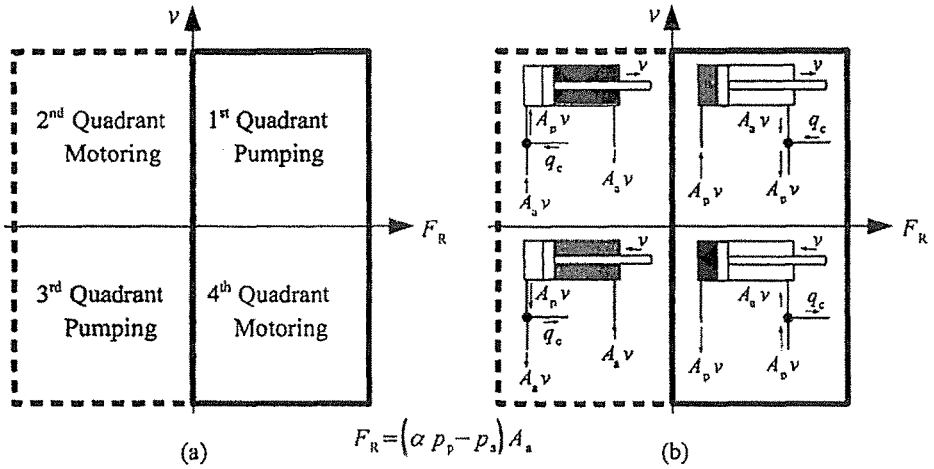
FIG. 3(*a*) shows a non-conventional velocity versus cylinder force diagram for a hydrostatic actuator circuit, where the cylinder force on the abscissa axis is calculated as a weighted pressure differential across the cylinder multiplied by the annulus area on the rod side of the piston.

FIG. 3 shows a velocity versus cylinder force diagram for single-rod actuator circuits. The diagram differs from usual representations that show the external load of the hydraulic cylinder at the abscissa axis. In FIG. 3, the cylinder force (also known as the "actuating force") is instead defined as the difference between the weighed pressure $\alpha p_p - p_a$ multiplied by the annulus area, $A_\alpha$ (see FIG. 1), where $\alpha = A_p/A_a$. The cylinder force $F_R$ multiplied by the cylinder speed v gives the power at the pump/motor in such a way that when $F_R v > 0$, energy flows from the pump to the cylinder and when $F_R v < 0$, energy flows from the cylinder to the pump. These energy modes are hereby defined as pumping and motoring modes, respectively. This is indicated in FIG. 3(*a*), where the energy modes coincide precisely with the geometrical quadrants 1 through 4.

Figure 1:
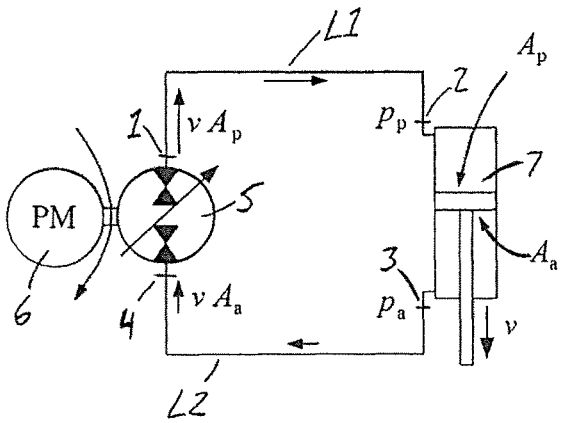
FIG. 1 schematically illustrates how a hydrostatic actuator with the input and output ports of a reversible pump directly connected to the ports of a hydraulic cylinder starves the return side of the pump during operation in a first direction extending the hydraulic cylinder.

FIG. 3(*b*) shows the flow configurations into and out of the hydraulic cylinder in each quadrant. In the figure, the pressurized side of the cylinder is also indicated by darkened shading of the pressurized side. In every case, the flow corresponding to the pressurized side of the cylinder matches the pump flow. At quadrant 1, the pump outputs the flow $A_p v$ at its first port 1 (FIG. 1, 2). The flow coming out of the cylinder is $A_a v < A_p v$ and, therefore, the flow difference $q_c = (A_p - A_a)v$ must be supplied by the charge circuit into the pump's second port 4 through the second main line L2. At quadrant 2, the pump, operating as a motor, receives the flow $A_a v$ into its second port 4 and outputs the same flow $A_a v$ at its first port 1. The flow consumed by the cylinder is $A_p v > A_a v$ and, therefore, the flow difference $q_c = (A_p - A_a)v$ must be supplied by the charge circuit into the first main line L1 between ports 1 and 2. At quadrant 3, the pump outputs the flow $A_a v$ at its second port 4. The flow coming out of the cylinder is $A_p v > A_a v$ and, therefore, the flow difference $q_c = (A_p - A_a)v$ must be diverted from the first main line L1 into the charge circuit. At quadrant 4, the pump, operating as a motor, receives the flow $A_p v$ into its first port 1 and outputs the same flow $A_p v$ at its second port 4. The flow consumed by the cylinder is $A_a v < A_p v$ and, therefore, the flow difference $q_c = (A_p - A_a)v$ must be diverted from the second main line L2 into the charge circuit. From this, it is concluded that the charge circuit should communicate with the rod-side of the cylinder at quadrants 1 and 4 and with the cap-side of the cylinder at quadrants 2 and 3, as indicated by the solid and dashed rectangles in FIGS. 3(*a*) and (*b*). Thus, knowledge of the cylinder force $F_R$ is sufficient to design a circuit for controlling the valve (or valves) that selectively connect the charge circuit to the main lines.

According to what has been laid out above, the charge circuit should connect to the rod-side of the cylinder when $F_R > 0$. Likewise, the charge circuit should connect to the cap-side of the cylinder when $F_R < 0$. These two basic conditions can be summarized as follows $$\begin{cases} \alpha p_p > p_a; & \text{charge circuit to rodside connection} \\ \alpha p_p < p_a; & \text{charge circuit to capside connection} \end{cases} \quad (1)$$

The inequalities (1) can also be written as $$\begin{cases} p_p > \frac{p_a}{\alpha}; & \text{charge circuit to rodside connection} \\ p_p < \frac{p_a}{\alpha}; & \text{charge circuit to capside connection} \end{cases} \quad (2)$$

The situation when $p_p = p_a$ is undefined and should be avoided. This can be done by observing that the pressurized sides of the cylinder are uniquely defined for quadrants 1 and 4 and for quadrants 2 and 3 (FIG. 3(*b*)). Therefore, reliance can be made on a buildup of a minimum pressure threshold $p_{cr}$, before any connection with the charge circuit takes place. This is done by modifying the conditions (1) and (2) into $$\begin{cases} (\alpha p_p > p_a) \wedge (p_p > p_{cr}); & \text{charge circuit to rodside connection} \\ (\alpha p_p < p_a) \wedge (p_a > p_{cr}); & \text{charge circuit to capside connection} \end{cases} \quad (3)$$

$$\begin{cases} \left(p_p > \frac{p_a}{\alpha}\right) \wedge (p_p > p_{cr}); & \text{charge circuit to rodside connection} \\ \left(p_p < \frac{p_a}{\alpha}\right) \wedge (p_a > p_{cr}); & \text{charge circuit to capside connection} \end{cases} \quad (4)$$

While the forgoing example uses the same pressure threshold for both conditions, another embodiment may use two threshold pressure values $p_{cr1}$ and $p_{cr2}$. Either conditions (3) or conditions (4) are sufficient to trigger closing of the valve (or valves) that connect the charge circuit to the cylinder.

Figure 4:
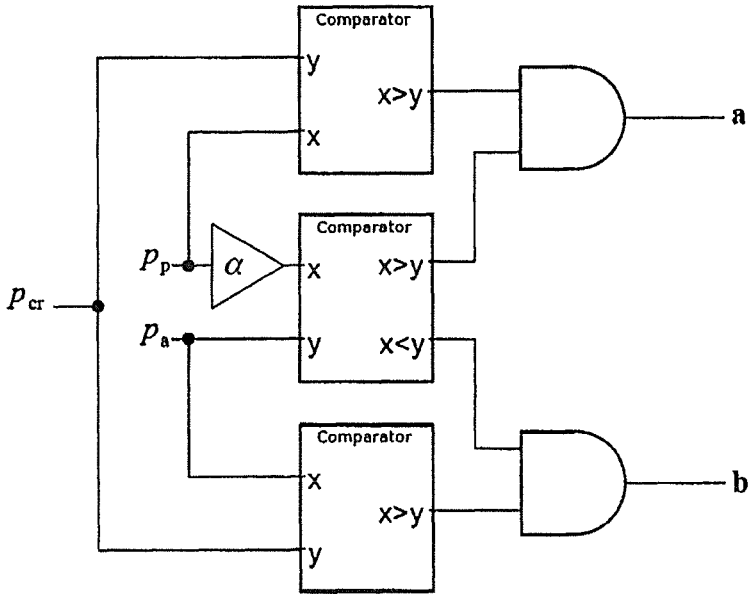
FIG. 4 is a generic representation of logic conditions used to control operation of the hydrostatic actuator of the present invention.

FIG. 4 shows a generic representation of conditions (3), where the output signals, a and b, can be used to control the connections between the charge circuit and the cylinder rod and cap-sides. Different technologies may be used to reproduce the logic circuit shown in FIG. 4. In the present application, three different preferred embodiments are described below.

Figure 2:
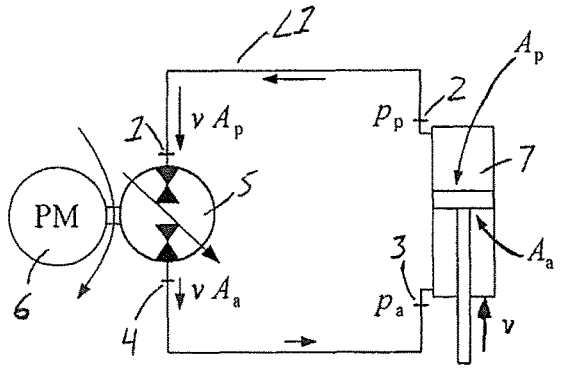
FIG. 2 schematically illustrates how the hydraulic cylinder overfeeds the return port of the pump in operation of the FIG. 1 actuator in the reverse direction collapsing the hydraulic cylinder.
Figure 5:
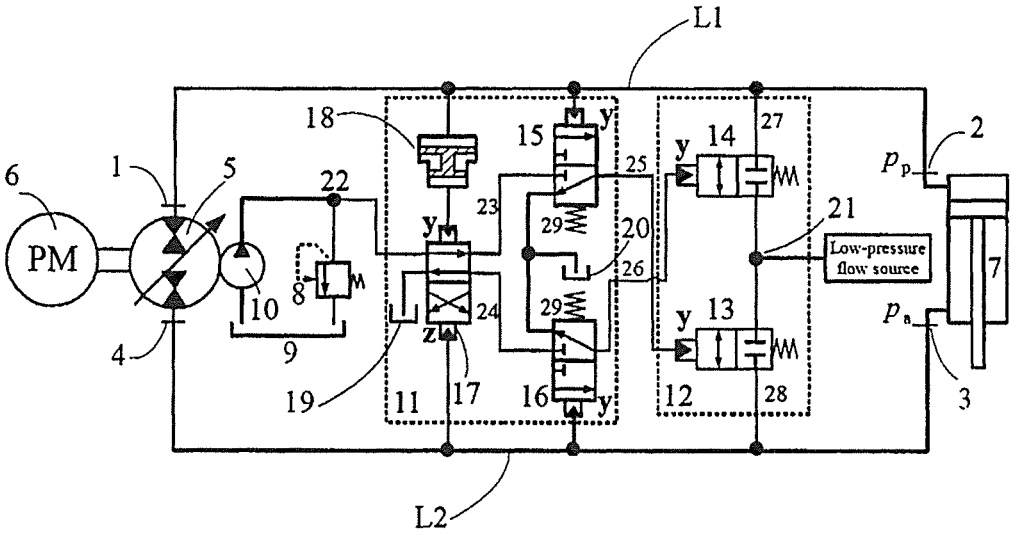
FIG. 5 schematically illustrates a hydrostatic actuator according to a first embodiment of the present invention.

FIG. 5 shows a first embodiment hydrostatic actuator composed of a reversible main pump 5 driven by a prime mover 6 and connected to a single-rod hydraulic cylinder 7. In the illustrated configuration, the charging circuit features a charge pump 10 sharing the same shaft of the main pump 5, which is often the case for some commercially available pump models. The main pump 5 can also operate as a motor. When operating as a pump, the displacement can vary continuously from a negative to a positive value so that the cylinder can be driven by the pump in both directions. Using the same numbering scheme as the background illustrations in FIGS. 1 and 2, the pump features a first port 1 and second port 4, and the hydraulic cylinder features a cap side port 2 and a rod side port 3. First pump port 1 is connected to cap side port 2 by first main line L1, and second pump port 4 is connected to rod side port 3 by second main line L2.

Connected parallel to one another between the first and second main lines L1, L2 are a Signal Processing Module 11 and a Compensation Flow Module 12, which collectively form a charge control system for controlling selective connection of the charging circuit to the cap and rod sides of the hydraulic cylinder via the first and second main lines, respectively. The Signal Processing Module in the first embodiment is a hydraulic implementation of the logic circuit shown in FIG. 4, and is composed of a pressure amplifier 18 whose gain is precisely given by $\alpha = A_p/A_a$, a pressure-comparing 4×2 directional valve 17 hydraulically piloted from both of its two ends, and two 3×2 spring-returned directional cracking valves 15 and 16 that are spring-biased into closed positions and hydraulically piloted into open positions by the cap and rod-side pressures communicated through the first and second main lines L1, L2, respectively.

The purpose of the Signal Processing Module 11 is to monitor the weighted pressure differential across the piston of the hydraulic cylinder, specifically to compare the weighted cap side pressure $\alpha p_p$ against the rod side pressure, and control the Compensation Flow Module 12 accordingly based on the logical conditions set forth above. The 4×2 pressure-comparing directional valve 17 thus has four connection ports and two operational positions. One side of the pressure-comparing directional valve 17 features a charge port connected to a charge circuit junction 22, and a dump port connected to a storage tank 19. The other side of the pressure-comparing directional valve 17 features two connection ports that each feed into a respective one of the cracking valves 15, 16 through a respective connection line 23, 24. This way, when the respective cracking valve is opened, the connection port of the pressure-comparing directional valve 17 is communicable with the Compensation Flow Module 12 through the respective connection line and cracking valve.

The operation of the Signal Processing Module 11 is now described. The pressure amplifier 18 receives the pressure $p_p$ from the cap-side of the cylinder through the first main line L1, and is preconfigured with a pressure gain calculated as the ratio of a full piston area of the hydraulic cylinder on the cap side thereof to an annular piston area of the hydraulic cylinder on the rod side thereof. The amplifier thus outputs a weighted cap side pressure $\alpha p_p$ which acts on the first pilot port y of the pressure-comparing directional valve 17. On the other hand, the pressure at the rod-side $p_a$ acts on the pilot port z of the said pressure-comparing directional valve 17 through the second main line L2. The pressure-comparing directional valve 17 thus compares the pressure signals at the two piloted ends from both main lines, and sets the pressures at connection lines 23 and 24 accordingly. If $\alpha p_p > p_a$ the pressure at connection line 23 is set to the pressure at charging circuit junction 22, as adjusted by a relief valve 8 of the charging circuit, and the pressure at connection line 24 is set to zero by communication with the storage tank 19 through the dump port of the pressure-comparing directional valve 17.

On the other hand, if $\alpha p_p < p_a$, the pressure at connection line 24 is set to the pressure at charging circuit junction 22, as adjusted by the relief valve 8, and the pressure at connection line 23 is set to zero by communication with the storage tank 19 through the dump port of the pressure-comparing directional valve 17. Cracking valves 15 and 16 are piloted into their open positions when the cap side and rod side pressures $p_p$ and $p_a$ are greater than a predetermined pressure threshold, i.e. the cracking pressure $p_{cr}$ set by the valve springs 29 that normally bias the cracking valves into their closed positions that disconnect the connection lines 23, 24 from the additional pilot lines 25, 26 that run from the cracking valves to the valve pilots in the Compensation Flow Module 12. Each cracking valve is a three-port, two-position directional valve, which on one side has a connection port to which the respective connection line 23, 24 is coupled and a dump port running to the storage tank 20, which may be the same storage tank 19 fed from the dump port of the pressure-comparing directional valve 17, and on the other side has a single port that feeds the respective pilot line 25, 26 of the Compensation Flow Module 12. In each cracking valve's default closed position, the connection port is closed and the respective pilot line 25, 26 is communicated with the cracking valve's dump port to set the pilot line pressure to zero. In the cracking valve's piloted open position, the connection port is communicated with the pilot port, and the dump port is closed.

This way, cracking valves 15 and 16 set the pressures at pilot lines 25 and 26 to zero by communication with the storage tank 20 through the dump ports of the cracking valves 15 and 16, or set the pressures at pilot lines 25 and 26 to the pressure at charging circuit junction 22. When the pressure at connection line 23 is equal to the pressure at charging circuit junction 22 and the pressure at the cap-side $p_p$ is greater than the cracking pressure $p_{cr}$, the pressure at charging circuit junction 22 and pilot line 25 are equalized. In all other instances, the pressure at pilot line 25 is set to zero. When the pressure at connection line 24 is equal to the pressure at charging circuit junction 22 and the rod-side pressure $p_a$ is greater than the cracking pressure $p_{cr}$, the pressure at charging circuit junction 22 and pilot line 26 are equalized. In all other instances, the pressure at pilot line 26 is set to zero. As mentioned above, the two cracking valves may have the same cracking pressure $p_{cr}$, or different respective cracking pressures $p_{cr1}$, $p_{cr2}$.

The resulting signals at pilot lines 25 and 26 activate a pair of flow compensation control valves 13 and 14 in the Compensation Flow Module 12 by moving these spring-returned 2×2 directional valves from their default closed positions between a low pressure flow source and the main lines L1, L2, into their open positions that connect the low pressure flow source to the main lines. Accordingly, in their open positions, the flow compensation control valves 14, 13 connect the cap and rod-side of the cylinder to a low-pressure flow source through compensation lines 27 and 28, respectively. The low-pressure flow source may be, but is not necessarily, the charge pump 10. If the same charge pump 10 is to be used for flow compensation and pressure signal generation, then junctions 21 and 22 are hydraulically connected.

Figure 6:
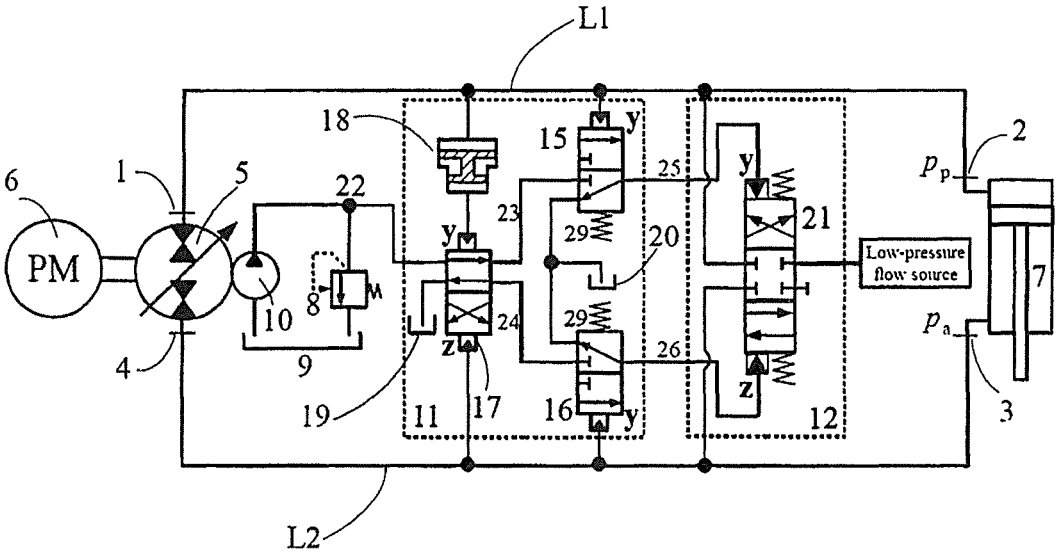
FIG. 6 schematically illustrates a hydrostatic actuator according to a second embodiment of the present invention.

While the first embodiment uses two separate flow compensation valves 13, 14, each in the form of a two-port, two-position, single-pilot, spring-returned directional valve, the quantity of flow compensation valves may be varied, as demonstrated by the second embodiment shown in FIG. 6. In the second embodiment, the Compensation Flow Module has only one 4×3 directional flow compensation valve 21, which is spring centred and hydraulically piloted at both ends, as shown in FIG. 6. The pressure signals coming from the Signal Processing Module at pilot lines 25 and 26 operate to pilot this four port, three-position, dual-pilot directional flow compensation valve 21 into one of two different open positions from its default spring-centered closed position that normally disconnects the low pressure flow source from both main lines L1, L2. The single flow compensation valve 21 thus alternately connects the cap and rod-sides of the hydraulic cylinder to the low-pressure flow source through the main lines based on alternating piloting of the valve through pilot lines 25, 26. Aside from this change in the quantity and type of flow compensation valve in the Compensation Flow Module 12, the overall actuator circuit performs exactly as the circuit of the first preferred embodiment.

Figure 8:
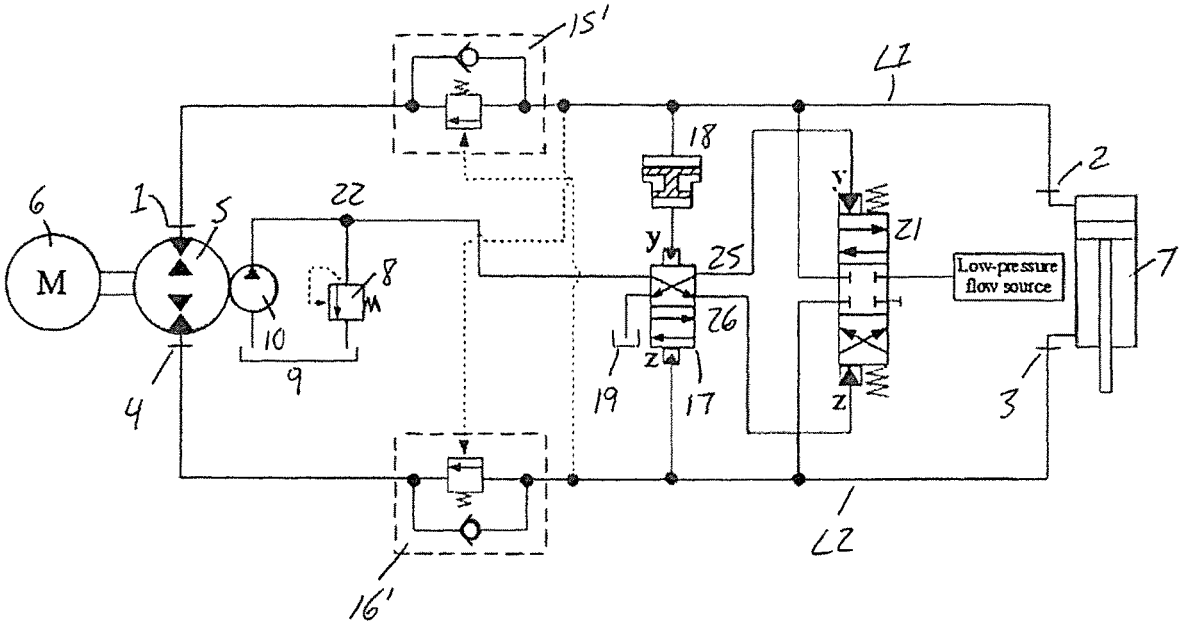
FIG. 8 illustrates a variant of the second embodiment hydrostatic actuator of FIG. 6.

A variant of the second embodiment is shown in FIG. 8, which guarantees that the pressures at both sides of the circuit always overcome the threshold value(s) before the cylinder starts to move. In the illustrated example, this is achieved by removing the first and second cracking valves 15, 16 from the FIG. 6 actuator, and replacing them with first and second counterbalance valves 15', 16' respectively installed in the first and second main lines, and respectively piloted by the second and first main lines. The first counterbalance valve 15' always allows flow from the pump's first port 1 to the cylinder's cap side port 2, but only allows flow in the reverse direction between these ports when piloted by a sufficient rod side pressure in the second main line L2 that exceeds the cracking pressure of the first counterbalance valve 15'. Likewise, the second counterbalance valve 16' always allows flow from the pump's second port 4 to the cylinder's rod side port 3, but only allows flow in the reverse direction between these ports when piloted by a sufficient cap side pressure in the first main line L1 that exceeds the cracking pressure of the second counterbalance valve. In this variant, the pilot lines 25, 26 are connected directly between the connection ports of the pressure-comparing directional valve 17 and the pilots of the flow compensation valve 21. The intermediate connection lines 23, 24 used in the FIG. 6 actuator between the pressure-comparing directional valve and the cracking valves are accordingly omitted in the FIG. 8 variant.

Figure 7:
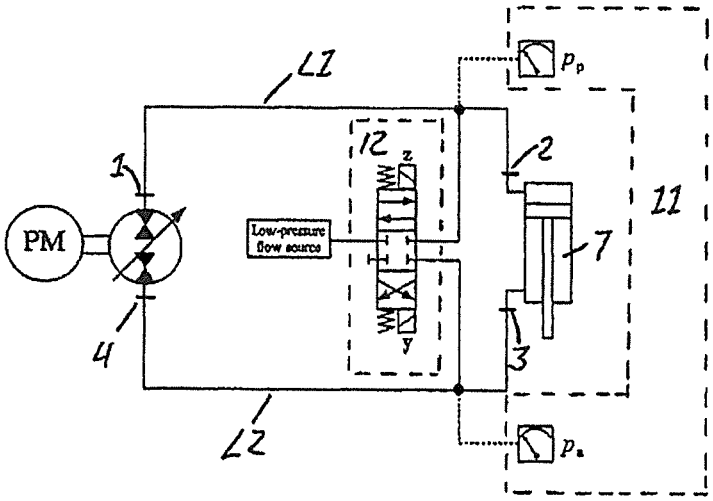
FIG. 7 schematically illustrates a hydrostatic actuator according to a third embodiment of the present invention.

The two forgoing embodiments use purely hydraulic circuits in the Signal Processing and Compensation Flow modules, thus relying solely on hydraulic signals to compare the cap side and rod side pressures and control the flow compensation valve(s) accordingly. In the third preferred embodiment shown in FIG. 7, the Signal Processing Module instead includes a computer or an electronic device that receives electronic pressure signals from two transducers placed at the cap and rod-side of the cylinder. The signals are inputted to a computer or a PLC (Programmable Logic Controller) and are processed according to the logic module in FIG. 4, or according to equations (3) or (4). The pressure signals are converted into electric signals, which are then electronically processed in a controller. The Compensation Flow Module features a similar flow compensation control valve to that of the second embodiment, but that uses solenoids, rather than hydraulic pilots, in order to electronically control the displacement of the valve out of its spring-biased central closed position into the appropriate one of the two open positions depending on the pressure comparison performed in the electronic Signal Processing Module. The controller thus outputs electric signals that activate the solenoids y and z, which thus connect the rod and cap sides of the cylinder to the low-pressure flow source, respectively.

The disclosed invention is believed to present new, advantageous, and/or improved aspects over the prior art. To the Inventors' knowledge, this is the first ever proposed single-rod circuit that imposes absolutely no critical regions where the circuit is likely to show a poor performance. Additionally, the proposed circuit can be realized with different technologies with simple on-off valves. The cost is, therefore, significantly reduced.

Potential applications for the disclosed invention include arms, booms and all types of hydraulic arms used in heavy machinery; replacement of the current double-rod actuators used for aerodynamic surface control in power-by-wire airplanes, such as the Airbus A380; and manufacturing plant machinery that currently make use of valve-controlled actuators.

Since various modifications can be made in my invention as herein above described, and many apparently widely different embodiments of same made, it is intended that all matter contained in the accompanying specification shall be interpreted as illustrative only and not in a limiting sense. For example, relief and anti-cavitation valves can be incorporated for pressure surge protection and cavitation prevention.

The invention claimed is:

1. A hydrostatic actuator comprising:

a hydraulic cylinder;

a reversible hydraulic pump;

a first main fluid line connecting a first side of the reversible hydraulic pump to a cap side of the hydraulic cylinder;

a second main fluid line connecting a second side of the reversible hydraulic pump to a rod side of the hydraulic cylinder;

a hydraulic charging circuit for supplying/releasing charging fluid to and from the first and second main fluid lines to compensate for differential flow on opposing sides of the hydraulic cylinder;

a charge control system configured to (i) monitor a weighted pressure differential across a piston of the hydraulic cylinder, where a weighing ratio of said weighted pressure differential is a ratio between a full piston area of the hydraulic cylinder on the cap side thereof and a lesser annular piston area of the hydraulic cylinder on the rod side thereof, (ii) connect the hydraulic charging circuit to the rod side of the hydraulic cylinder when a weighted cap side pressure exceeds the rod side pressure, and (iii) connect the hydraulic charging circuit to the cap side of the hydraulic cylinder when the weighted cap side pressure is less than the rod side pressure.

2. The hydrostatic actuator of claim 1 wherein the charge control system is further configured to connect the hydraulic charging circuit to the rod side or the cap side of the hydraulic cylinder only when a predetermined pressure threshold is exceeded at the cap side or rod side, respectively.

3. The hydrostatic actuator of claim 1 wherein the charge control system comprises a signal processing module comparing the rod side and cap side pressures, and a compensation flow module controlling flow from the charge circuit to the rod side and cap side of the hydraulic cylinder according to pressure comparison results from the signal processing module.

4. The hydrostatic actuator of claim 3 wherein the signal processing module is a hydraulic module.

5. The hydrostatic actuator of claim 3 wherein the signal processing module is an electronic module.

6. The hydrostatic actuator of claim 5 wherein the signal processing module comprises transducers operable to measure pressures at the cap side and the rod side of the hydraulic cylinder.

7. The hydrostatic actuator of claim 5 wherein the compensation flow module comprises an electronically controlled valve operated, at least in part, based on output signals from the electronic signal processing module.

8. The hydrostatic actuator of claim 1 wherein the charge control system comprises a pressure amplifier fed by pressure of the cap side of the hydraulic cylinder, and configured with a pressure gain based on said ratio of said full piston area of the hydraulic cylinder on the cap side thereof to said lesser annular piston area of the hydraulic cylinder on the rod side thereof.

9. The hydrostatic actuator of claim 1 wherein the charge control system comprises a pressure-comparing directional valve fed by the charging circuit and hydraulically piloted in opposite directions from the cap side pressure and the rod side pressure.

10. The hydrostatic actuator of claim 9 wherein the pressure-comparing directional valve comprises a charge port fed by the charging circuit, a dump port connected to a tank, and two connection ports for feeding two respective pilots of one or more compensation flow control valves that are operable to open and close connections of the charging circuit to the cap side and rod side of the hydraulic actuator, each connection port being communicated with either the charge port or the dump port depending on a current position of the pressure-comparing direction valve.

11. The hydrostatic actuator of claim 10 wherein the charge control system comprises a pair of spring-biased valves having respective pilots pressured by the cap side and rod side of the hydraulic cylinder.

12. The hydrostatic actuator of claim 11 wherein the pair of spring biased valves comprise cracking valves normally biased into closed positions between the pressure-comparing directional valve and the pilots of the one or more compensation flow control valves.

13. The hydrostatic actuator of claim 11 wherein the pair of spring biased valves comprise a first counterbalance valve installed in the first main line and piloted by the rod side of the hydraulic cylinder, and a second counterbalance valve installed in the second main line and piloted by the cap side of the hydraulic cylinder, each counterbalance valve always allowing flow therethrough from the pump to the hydraulic cylinder, but only allowing flow in a reverse direction from the hydraulic cylinder to the pump when the respective side of the cylinder from which the counterbalance valve is piloted is at a pressure value exceeding a cracking pressure of said counterbalance valve.

14. The hydrostatic actuator of claim 10 wherein the one or more compensation flow control valves comprises first and second spring-biased directional control valves respectively comprising the first and second pilots, and each connected between a low pressure flow source of the hydraulic charging circuit and a respective one of either the cap side or the piston side of the hydraulic cylinder.

15. The hydrostatic actuator of claim 14 wherein the low pressure flow source communicable with the hydraulic actuator via the one or more compensation flow control valves also feeds the charge port of the pressure-comparing directional valve.

16. The hydrostatic actuator of claim 10 wherein the one or more compensation flow control valves is a singular three-position directional control valve having the first and second pilots defined at opposing ends thereof, said singular three-position directional control valve being movable from a default closed position disconnecting a low pressure flow source of the hydraulic charging circuit from both the cap side and the piston side of the hydraulic cylinder, into either one of two open positions that each connect the low pressure flow source to a respective one of either the cap side or the piston side of the hydraulic cylinder.

17. The hydrostatic actuator of claim 1 wherein the charge control system comprises first and second spring-biased cracking valves having respective first and second pilots pressured by the cap side and rod side of the hydraulic cylinder, respectively, and normally biased into closed positions disconnecting the hydraulic charging circuit from the hydraulic cylinder.

18. The hydrostatic actuator of claim 1 wherein the charging circuit comprises a pair of directional spring-biased compensation flow control valves each operable to open and close a path from a low pressure flow source of the charging circuit to a respective one of either the cap side or the rod side of the hydraulic actuator.

19. The hydrostatic actuator of claim 1 wherein the charging circuit comprises a singular three-position directional compensation flow control valve movable from a default closed position disconnecting a low pressure flow source of the charging circuit from both the cap side and the piston side of the hydraulic cylinder, into either of two open positions each connecting the low pressure flow source to a respective one of either the cap side or the piston side of the hydraulic cylinder.

20. A method of controlling fluid flow to and from a hydraulic charging circuit in a hydrostatic actuator through hydraulic valves, said method comprising monitoring a weighted pressure differential across a piston of a hydraulic cylinder, where a weighing ratio of said weighted pressure differential is a ratio between a full piston area of the hydraulic cylinder on a cap side thereof and a lesser annular piston area of the hydraulic cylinder on a rod side thereof; connecting the hydraulic charging circuit to a rod side of the hydraulic cylinder when a weighted cap side pressure exceeds the rod side pressure, and connecting the hydraulic charging circuit to the cap side of the hydraulic cylinder when the weighted cap side pressure is less than the rod side pressure.

21. The method of claim 20 comprising monitoring the weighted pressure differential using a hydraulically operated signal processing module.

22. The method of claim 20 comprising monitoring the weighted pressure differential using an electronically operated signal processing module.

* * * * *